US007047882B2

(12) United States Patent
Minato

(10) Patent No.: US 7,047,882 B2
(45) Date of Patent: May 23, 2006

(54) PLANOGRAPHIC PLATE PRODUCING METHOD INCLUDING ADJUSTING MOISTURE CONTENT OF COATING FILM LAYER

(75) Inventor: Shinichiro Minato, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 38 days.

(21) Appl. No.: 10/984,775

(22) Filed: Nov. 10, 2004

(65) Prior Publication Data

US 2005/0089801 A1 Apr. 28, 2005

Related U.S. Application Data

(62) Division of application No. 10/644,069, filed on Aug. 20, 2003, now Pat. No. 6,855,206.

(30) Foreign Application Priority Data

Aug. 22, 2002 (JP) ..... 2002-241620

(51) Int. Cl.
*G03C 1/00* (2006.01)
*B41N 3/00* (2006.01)

(52) U.S. Cl. ..... 101/463.1; 101/401.1; 430/302; 118/663

(58) Field of Classification Search ..... 101/463.1, 101/465, 466, 467, 401.1; 430/273.1, 271.1, 430/302, 300; 118/663, 665, 688, 712; 427/8
See application file for complete search history.

(56) References Cited

U.S. PATENT DOCUMENTS 5,604,990 A 2/1997 Takekoshi

FOREIGN PATENT DOCUMENTS

| | | |
|---|---|---|
| EP | 1 076 013 A1 | 2/2001 |
| EP | 1 172 697 A2 | 1/2002 |
| JP | 8-146597 | 6/1996 |
| JP | 10-254187 | 9/1998 |

OTHER PUBLICATIONS

Japanese Abstract No. 2003228176, dated Aug. 15, 2003.
Japanese Abstract No. 03217839, dated Sep. 25, 1991.

*Primary Examiner*—Leslie J. Evanisko
(74) *Attorney, Agent, or Firm*—Sughrue Mion, PLLC

(57) ABSTRACT

A controller for a moisture adjusting device of the present invention reads out a target moisture content set in advance in a data table in accordance with a type of a planographic printing plate; determines, every predetermined control period, a moisture content of an overcoat layer (measured moisture content) based on a measured signal SW; and calculates a difference (deviation) between the measured moisture content and the target moisture content. For example, if the measured moisture content of the overcoat layer is lower than the target moisture content, the controller sets an adjusted moisture content which is higher than the measured moisture content and controls the humidity and the temperature within a humidity conditioning zone so that an interposing paper web (protective sheet material) attains the adjusted moisture content within the humidity conditioning zone.

11 Claims, 3 Drawing Sheets

PLANOGRAPHIC PLATE PRODUCING METHOD INCLUDING ADJUSTING MOISTURE CONTENT OF COATING FILM LAYER

This is a divisional of Application Ser. No. 10/644,069 filed Aug. 20, 2003, now Pat. No. 6,855,206, issued Feb. 15, 2005.

CROSS-REFERENCE TO RELATED APPLICATION

This application claims priority under 35 USC 119 from Japanese patent application, No. 2002-241620, the disclosure of which is incorporated by reference herein.

BACKGROUND OF THE INVENTION

1. Field of the Invention

The present invention relates to a moisture adjusting device for adjusting a moisture content contained in a coating film layer formed by applying a coating solution containing an organic solvent, water and the like onto a support, and a planographic printing plate producing method that uses the moisture adjusting device.

2. Description of the Related Art

In recent years, along with development in digital processing techniques for image processing, a photopolymer which is formed so as to have high sensitivity to a laser beam in a visible range by using photo-radical polymerization, is often used as a photosensitive material for planographic printing plate in order to implement a direct plate-making system. In the planographic printing plate, provided with a photosensitive layer made of the photopolymer and formed thereon (hereinafter referred to as "photopolymer-type planographic printing plate"), an image forming surface (photosensitive layer) of the planographic printing plate is scanned with a laser beam with a sufficiently small beam diameter based on image data, so that a photo-polymerization reaction occurs at the photosensitive layer provided on a support, thereby curing the exposed portion thereof. Namely, by using the photopolymer-type planographic printing plate, characters and images can be directly formed on the image forming surface of the planographic printing plate without using a film original (lith film). Because oxygen in the air becomes a factor in inhibiting a photopolymerization reaction, the photopolymer-type planographic printing plate is usually provided with an overcoat layer that serves as an oxygen blocking film, made of a transparent resin such as a polyvinyl alcohol (PVA) and is provided on the surface of the image forming surface. The photosensitive layer is covered with the overcoat layer.

In most cases, a support for such planographic printing plate is produced as follows. Namely, a roughening treatment is performed on one side surface or both side surfaces of an elongated band-shaped aluminum plate made of aluminum or an alloy comprising aluminum as a main component (hereinafter referred to as an "aluminum alloy"). Then, an anodized film is formed by an anodizing treatment in order to improve wear resistance. A photosensitive material (photopolymer) is applied on the anodized film on the support, and dried, whereby a photosensitive layer is formed. Subsequently, a PVA is applied so as to cover the entire surface of the photosensitive material and dried, so that an overcoat layer is formed. A protective interposing paper (hereinafter simply referred to as an "interposing paper"), for example, may be adhered to a product web as a blank of the planographic printing plate produced as described above. Further, the product web may be cut into a product size. In this way, the product web is processed into a planographic printing plate product.

It is known that a product quality of the above-described planographic printing plate is influenced greatly by a moisture content of the overcoat layer. A large moisture content may lead to an increase in sensitivity, and thus fogging problems may easily occur. On the other hand, a small moisture content may lead to a decrease in sensitivity. Accordingly, the planographic printing plate has a problem in that the quality thereof becomes unstable when the moisture content of the overcoat layer is not within an appropriate range.

In recent years, a wide variety of photopolymer-type planographic printing plates with different properties have been developed in accordance with various needs of users. These photopolymer type planographic printing plates have different appropriate moisture contents in their overcoat layers depending on characteristics such as photosensitivity and the like. For this reason, a producing line for planographic printing plate is required to be capable of precisely adjusting the moisture content of the overcoat layer to different target values depending on the type of the photopolymer type planographic printing plate. In order to meet such requirements, the producing line for the photopolymer type planographic printing plate is usually provided with a humidity conditioning zone for adjusting the moisture content of a product web with the overcoat layer being formed thereon. By adjusting a humidity within the humidity conditioning zone, the moisture content of the overcoat layer of the product web which has passed through the humidity conditioning zone can be adjusted to a target value with high precision.

However, if the moisture content of the overcoat layer of the product web is adjusted to a target value with high precision in the humidity conditioning zone, when an interposing paper is later adhered to the surface of the overcoat layer, the moisture content of the overcoat layer may be changed over time by the moisture content of the interposing paper. As a result, the moisture content of the overcoat layer may deviate from the target value. Moreover, the speed of the producing line for planographic printing plate has been increasing. Thus, if the moisture content of the overcoat layer before being subjected to the moisture adjustment greatly deviates from a target value, it is difficult to adjust with high precision the moisture content of the product web to a target value, with the overcoat layer being formed thereon, only in the humidity conditioning zone with limited length.

SUMMARY OF THE INVENTION

The present invention is developed in view of the above-described facts, and one object of the invention is to provide a coating film layer moisture adjusting device which is capable of maintaining with high precision a moisture content contained in a coating film layer formed on a support web to a target moisture content even after a protective sheet material is adhered to the coating film layer.

In view of the above-described facts, another object of the invention is to provide a planographic printing plate producing method which is capable of maintaining with high precision a moisture content contained in an overcoat layer formed on a surface of a photosensitive layer or a heat-sensitive layer, at a target moisture content set in advance in accordance with a type of a planographic printing plate, even after a protective sheet material is adhered to the overcoat layer.

According to a first aspect of the invention, there is provided a coating film layer moisture adjusting device, for adjusting, to a target moisture content, a moisture content of the coating film layer formed by applying a coating solution to an elongated band-shaped support, which support web is continuously conveyed, the device comprising: a humidity conditioning zone for having a protective sheet material, which is formed in an elongated sheet-shape and is to be adhered to a surface of the coating film layer formed on the support, pass therethrough; humidity conditioning means for adjusting humidity in the humidity conditioning zone; adhering means, which is disposed at a downstream side of the humidity conditioning zone and is for continuously adhering the protective sheet material to the surface of the coating film layer; moisture content measuring means which is disposed at an upstream side of the adhering means in a conveyance route of the support web and is for measuring a moisture content of the coating film layer; and humidity conditioning control means for controlling the humidity conditioning means so that the humidity in the humidity conditioning zone becomes a target humidity corresponding to the measured moisture content of the coating film measured by the moisture content measuring means and the target moisture content, and adjusting the moisture content of the protective sheet material, which has passed through the humidity conditioning zone, to an adjusted moisture content corresponding to the measured moisture content and the target moisture content.

According to the moisture adjusting device of the invention, the humidity conditioning control means controls the humidity conditioning means so that the humidity within the humidity conditioning zone becomes a target humidity corresponding to the measured moisture content and the target moisture content, and adjusts the moisture content of the protective sheet material which has passed through the humidity conditioning zone to an adjusted moisture content corresponding to the measured moisture content and the target moisture content. If the moisture content (measured moisture content) of the coating film layer formed on the support is approximately the same as the target moisture content, an adjusted moisture content which is approximately the same as the target moisture content is set and the moisture content of the protective sheet material is adjusted to the adjusted moisture content in the humidity conditioning zone. Then, moisture hardly moves between the coating film layer of the support web with the protective sheet material being adhered thereto and the protective sheet material. As a result, the moisture content of the coating film layer of the support web can be stably maintained at the target moisture content even after the protective sheet material is adhered to the coating film layer.

If the moisture content (measured moisture content) of the coating film layer formed on the support is lower than the target moisture content, an adjusted moisture content which is higher than the measured moisture content is set in accordance with the difference (deviation) between the measured moisture content and the target moisture content, and the moisture content of the protective sheet material is adjusted to the adjusted moisture content in the humidity conditioning zone. Then, moisture flows from the protective sheet material to the coating film layer of the support web with the protective sheet material being adhered thereto. As a result, after the protective sheet material is adhered to the coating film layer, the moisture content of the coating film layer of the support web can be increased so as to approximate the target moisture content with high precision.

If the moisture content (measured moisture content) of the coating film layer formed on the support is higher than the target moisture content, an adjusted moisture content which is lower than the measured moisture content is set in accordance with the difference (deviation) between the measured moisture content and the target moisture content, and the moisture content of the protective sheet material is adjusted to the adjusted moisture content in the humidity conditioning zone. Then, moisture flows from the coating film layer of the support web with the protective sheet material being adhered thereto to the protective sheet material. As a result, after the protective sheet material is adhered to the coating film layer, the moisture content of the coating film layer of the support web can be decreased so as to approximate the target moisture content with high precision.

According to a second aspect of the invention, there is provided a planographic printing plate producing method, comprising the steps of: forming an overcoat layer on a surface of at least one of a photosensitive layer or a heat-sensitive layer after forming the at least one of the photosensitive layer or the heat-sensitive layer on a support; and adhering a protective sheet material, a moisture content thereof having been adjusted by the moisture adjusting device of above, to the surface of the overcoat layer.

According to the planographic printing plate producing method of the second aspect, a photosensitive layer or a heat-sensitive layer is formed on a support and then an overcoat layer is formed on the surface of the photosensitive layer or the heat-sensitive layer. Further, a protective sheet material with moisture content thereof having been adjusted by the moisture adjusting device of the first aspect is adhered to the surface of the overcoat layer.

According to the second aspect of the present invention, the moisture content contained in the overcoat layer formed on the surface of the photosensitive layer or the heat-sensitive layer can be maintained with high precision or adjusted over time to a target moisture content set in advance in accordance with a type of a planographic printing plate after the protective sheet material is adhered to the overcoat layer. Thus, the quality of planographic printing plate can be prevented in an effective manner from becoming unstable due to the influence of the moisture content of the overcoat layer.

DETAILED DESCRIPTION OF THE INVENTION

A producing line for planographic printing plate to which a moisture adjusting device is applied according to embodiments of the present invention will be described hereinafter with reference to the drawings.

(First Embodiment)

Figure 1:
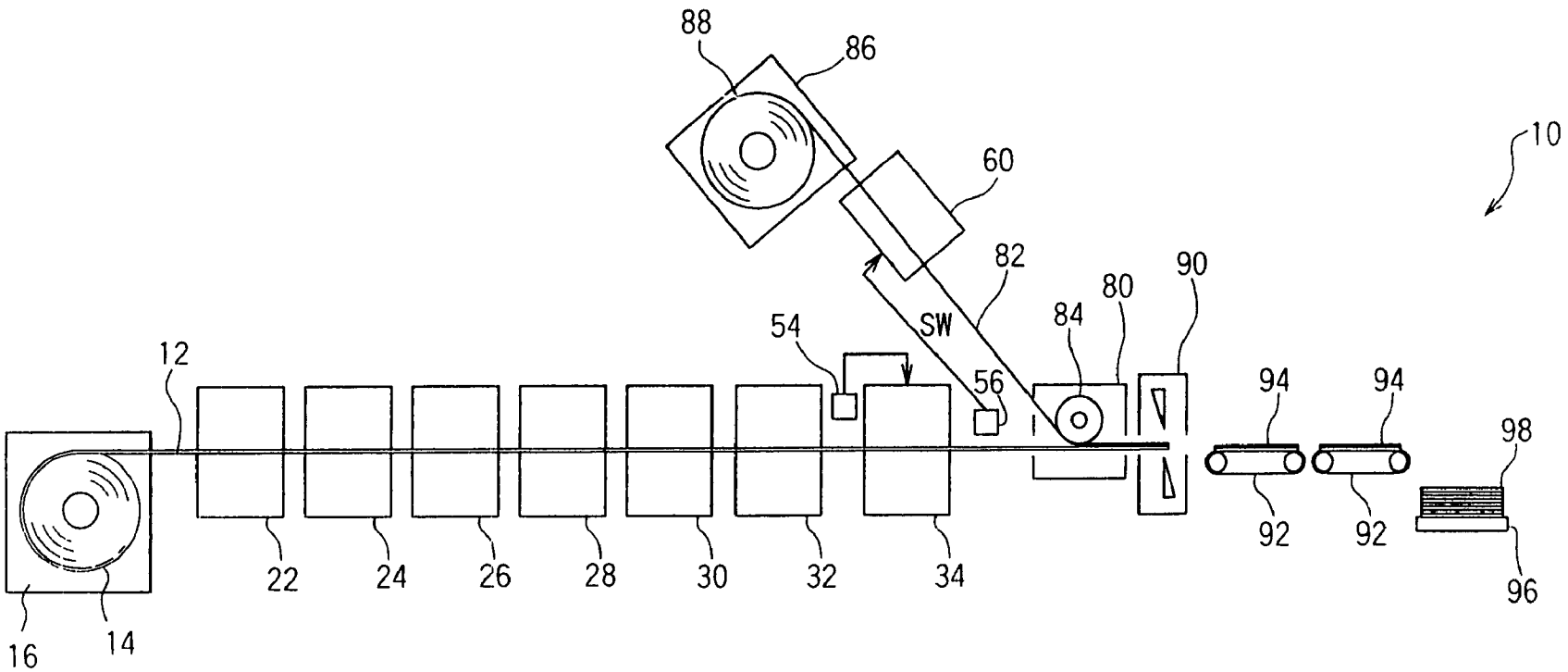
FIG. 1 is a side view schematically illustrating a structure of a producing line for planographic printing plate, to which a moisture adjusting device is applied according to embodiments of the present invention.

FIG. 1 shows a producing line for planographic printing plates according to a first embodiment of the invention. A feeding device 16 is disposed at a most upstream side (the left side in FIG. 1) of the producing line 10. An aluminum coil 14 on which an aluminum web 12 with a thickness of, e.g., 0.1 to 0.5 mm is taken up in a roll is loaded within the feeding device 16. The feeding device 16 feeds the aluminum web 12 toward a downstream side at a speed corresponding to a producing speed of the entire producing line 10 (i.e., a line speed). The aluminum web 12 serving as a support for the planographic printing plates may be made of, e.g., JIS 1050 material, JIS 1100 material, JIS 1070 material, Al-Mg-based alloy, Al-Mn-based alloy, Al-Mn-Mg-based alloy, Al-Zr-based alloy and Al-Mg-Si-based alloy or the like.

A mechanical or electrochemical roughening device 22 is disposed at a downstream side of the feeding device 16 in the producing line 10. The roughening device 22 performs a mechanical or chemical roughening treatment upon the surface of the aluminum web 12. The producing line 10 is provided with an anodizing device 24 for performing an anodizing treatment for the aluminum web 12 which has been subjected to the roughening treatment. The anodizing device 24 anodizes the surface of the aluminum web 12 by a known liquid-contact supplying system to form an anodized film with a high degree of hardness on the surface of the aluminum web 12. At this time, 0.1 to 10 $g/m^2$ of anodized film, more preferably 0.3 to 5 $g/m^2$ of anodized film is formed on the surface of the aluminum web 12.

As shown in FIG. 1, a coating device 26 for coating a photosensitive coating solution onto the aluminum web 12 and a drying device 28 are disposed at a downstream side of the anodizing device 24. The coating device 26 coats a photosensitive coating solution onto the surface of the aluminum web 12 by, for example, bar coating (or rod coating) to form a photosensitive layer with a constant thickness. When a thermal-type planographic printing plate is produced, the coating device 26 coats, instead of the photosensitive coating solution, a heat-sensitive coating solution on the aluminum web 12. As the drying device 28, for example, a hot-air drying device is employed, which is disposed at a downstream side of the coating device 26 to blow hot air into a drying tank with a heat insulating structure to dry a photosensitive layer on the aluminum web 12 which is being conveyed within the drying tank.

A coating device 30 for coating an overcoat solution of polyvinyl alcohol (PVA) or the like and a drying device 32 are disposed at a downstream side of the drying device 28. The coating device 30 coats an overcoat solution on the surface of the photosensitive layer on the aluminum web 12 by, for example, a slide coating to form an overcoat layer with a constant thickness. The slide coating is a kind of film forming method for forming a coating film layer (overcoat layer) on the aluminum web 12 by an overcoat solution with medium viscosity. Specifically, the overcoat solution is supplied on an inclined surface. The overcoat solution is flown along the inclined surface so as to be formed into a film with a constant thickness. Then, the overcoat solution formed into a film is moved in a flowing manner on the photosensitive layer for the aluminum web 12. As a result, the overcoat layer is formed on the photosensitive layer.

The drying device 32 disposed at the downstream side of the coating device 30 basically has the same structure as that of the drying device 28, and dries an overcoat layer formed on the aluminum web 12 moving within its drying tank. Thus, an overcoat layer serving as an oxygen blocking layer is formed on the aluminum web 12 so as to cover the photosensitive layer. Since appropriate heating and drying conditions for the photosensitive layer are different from those of the overcoat layer, the temperature of hot air supplied to the respective drying tanks and the length of the drying tanks along a conveyance direction are appropriately set depending on drying conditions of the respective layers. When exiting the drying device 32, the overcoat layer on the aluminum web 12 is in an absolute dry state where its moisture content is sufficiently reduced.

The producing line 10 is provided with a first (preliminary) moisture adjusting device 34 at a downstream side of the drying device 32. The first moisture adjusting device 34 adjusts a content as a weight ratio of moisture contained in the overcoat layer formed on the aluminum web 12 (hereinafter referred to as "moisture content") in accordance with a type or the like of planographic printing plate. A structure of the first moisture adjusting device 34 is substantially the same as that of a secondary moisture adjusting device 60 for adjusting a moisture content of an interposing sheet web 82, to be described later. Specifically, the first moisture adjusting device 34 controls (feedback-controls) the humidity within a humidity conditioning tank, to which the aluminum web 12 which has been carried out from the drying device 32 is fed, in accordance with a target moisture content and a measured moisture content of the overcoat layer measured by a first moisture content sensor (first or preliminary moisture content measuring means) 54 (see FIG. 1) immediately before being conveyed into the humidity conditioning tank, so as to adjust the moisture content of the overcoat layer formed on the aluminum web 12 to a target moisture content within the humidity conditioning tank.

An adhering device (means) 80 for adhering the interposing paper web 82 is disposed at a downstream side of the first moisture adjusting device 34 in the producing line 10. The adhering device 80 makes, the elongated band-shaped interposing paper web 82 fed from a feeding device 86, press-contact the aluminum web 12 by a press-contact roll 84 and adheres the interposing paper web 82 to the surface of the overcoat layer in the aluminum web 12 by electrostatic adhesion. An interposing paper roll 88 in which the interposing paper web 82 is taken up in a roll is loaded within the feeding device 86. The feeding device 86 feeds the interposing paper web 82 from the interposing paper roll 88 toward the adhering device 80 at a speed which is the same as the conveyance speed for the aluminum web 12.

In the producing line 10, the aluminum web 12 having the interposing paper web 82 being adhered thereto is cut by a cutting device 90 into a predetermined product length, so that a planographic printing plate 94 is produced as a product. The planographic printing plate 94 is conveyed by, e.g., belt conveyers 92 to a stacking device 96. On this stacking device 96, a predetermined number of the planographic printing plates are stacked so as to be made into a product bundle 98. The product bundle 98 is conveyed from the producing line 10 to, e.g., an equipment at which a packaging step is performed, packaged with an inner packaging paper having light blocking property and moisture-proof property (inner packaging), further packaged with an outer packaging paper such as a corrugated cardboard if desired, and then stored until a shipping period.

Figure 2:
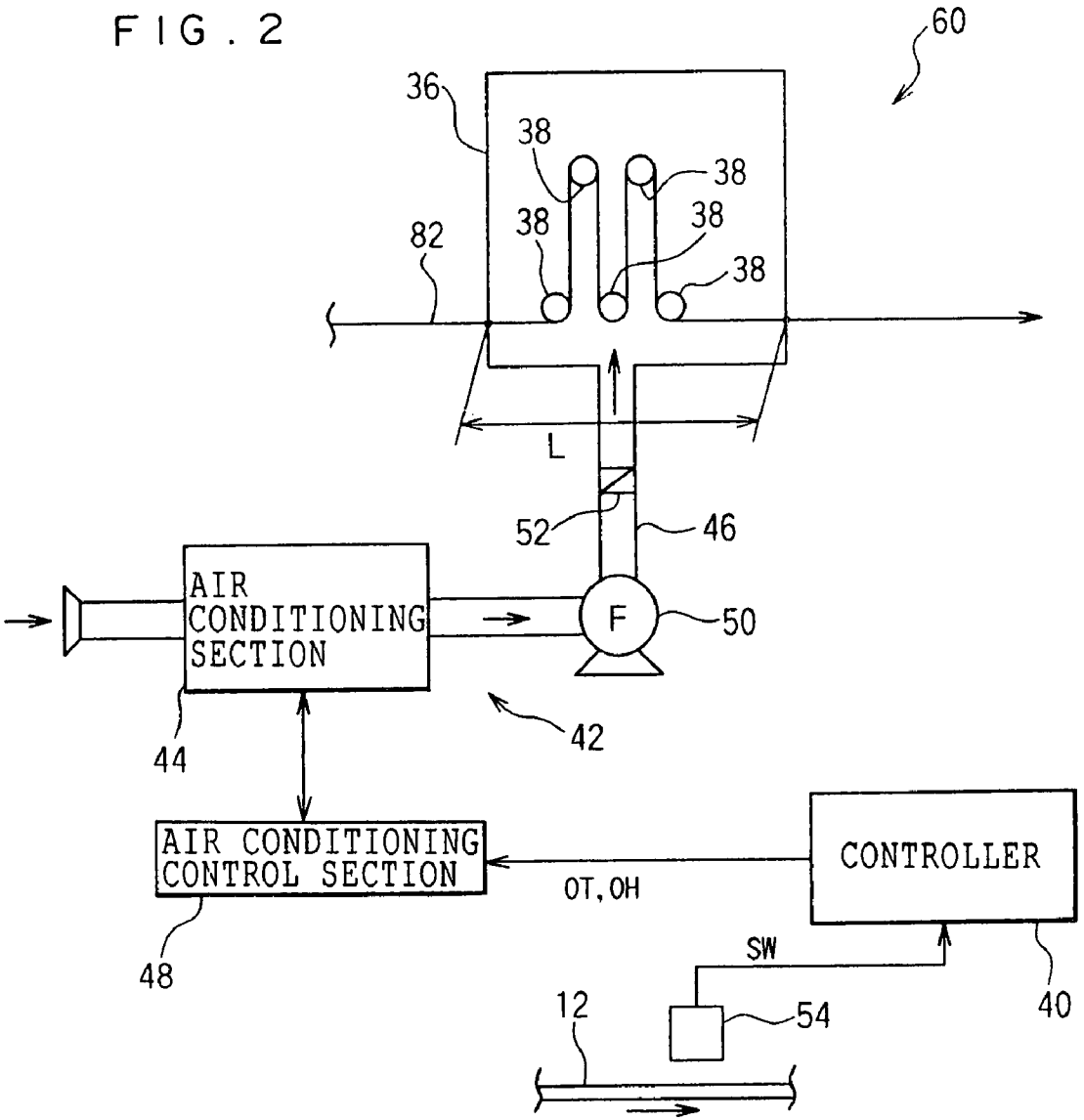
FIG. 2 is a block diagram illustrating a structure of a secondary moisture adjusting device according to a first embodiment of the invention.

Further, in the producing line 10, the secondary moisture adjusting device 60 for adjusting the moisture content of the interposing paper web 82 is disposed between the feeding device 86 for the interposing paper web 82 and the adhering device 80. The secondary moisture adjusting device 60 is provided with, as shown in FIG. 2, a humidity conditioning tank 36 formed in a housing along a conveyance route of the interposing paper web 82. The humidity conditioning tank 36 is structured so as to have a heat-insulating property and to block flowing of outside air. The interior space of the humidity conditioning tank is structured as a humidity conditioning zone for adjusting the moisture content of the overcoat layer. A plurality of (five in FIG. 2) pass rolls 38 for conveying and guiding the interposing paper web 82 are disposed within the humidity conditioning tank 36. These pass rolls 38 are alternately disposed at a top side and a bottom side within the humidity conditioning tank 36 along the conveyance route of the interposing paper web 82. Within the humidity conditioning tank 36, the interposing paper web 82 is conveyed vertically along a zigzag path. Thus, as compared to the case of conveying the interposing paper web 82 linearly, the length of the route of the interposing paper web 82 (the pass length) can be extended and the time from when the interposing paper web 82 enters the humidity conditioning tank 36 to the time when the interposing paper web 82 exits the tank can be increased. Instead of the pass rolls 38 or in addition to them, a web handling device for tension adjustment formed of a drive roll, a dancer mechanism or the like may be provided within the humidity conditioning tank 36.

As shown in FIG. 2, the secondary moisture adjusting device 60 is provided with a controller (humidity conditioning control means) 40 for inputting and outputting various types of information to and from a host process computer (not shown) which manages production or the like and for controlling the entire secondary moisture adjusting device 60, and an air conditioning unit (means) 42 for adjusting the humidity and the temperature within the humidity conditioning tank 36. The air conditioning unit 42 is provided with an air conditioning section 44 connected via a duct 46 to the humidity conditioning tank 36 and an air conditioning control section 48. The air conditioning section 44 is structured by combining a heat exchanger, a dehumidifier, a humidifier or the like and is capable of adjusting the temperature and the humidity of air taken from outside. The air conditioning control section 48 controls the air conditioning section 44 in accordance with a target temperature OT and a target humidity OH set by the controller 40. The controller 40 inputs and outputs various types of information to and from the host process computer (not shown) for managing production or the like in the entire producing line 10 and controls the entire secondary moisture adjusting device 60 in accordance with a type of planographic printing plate or the like.

A blower 50 and an air filter 52 are disposed at a middle of the duct 46 of the air conditioning unit 42. The blower 50 blows air with its humidity and temperature having been adjusted by the air conditioning section 44 toward the humidity conditioning tank 36. Foreign matter such as dust in the air is removed by the air filter 52 and the air is supplied by the blower 50 to the humidity conditioning tank 36 as conditioned air with a constant flow rate. The air conditioning control section 48 controls the air conditioning section 44 so that the temperature and the humidity of the conditioned air to be supplied to the humidity conditioning tank 36 by the air conditioning section 44 become a target temperature OT and a target humidity OH, respectively. A straightening member (not shown) such as a straightening plate or a nozzle is disposed within the humidity conditioning tank 36. The conditioned air blown from the duct 46 to the humidity conditioning tank 36 is straightened by the straightening member so as to be blown uniformly on the overcoat layer formed on the aluminum web 12 or to be flown along the surface of the overcoat layer, and then discharged outside the tank through an exhaust port (not shown) provided at the humidity conditioning tank 36.

On the other hand, as shown in FIG. 1, in the producing line 10, a secondary moisture content sensor (secondary moisture content measuring means) 56 is disposed immediately behind the first moisture adjusting device 34 so as to face opposite of the overcoat layer of the aluminum web 12. The secondary moisture content sensor 56 continuously measures the moisture content of the overcoat layer by a known infrared reflection system and outputs a measured signal SW corresponding to a measured value to the controller 40. Then, the controller 40 calculates, for every fixed period, a deviation of a measured value (measured moisture content SW) from the target value of the moisture content (target moisture content) based on the measured signal from the secondary moisture content sensor 56. Further, the controller 40 calculates the target temperature OT and the target humidity OH based on the deviation and updates the target temperature OT and the target humidity OH set in the air conditioning section 44.

Next, an operation of the producing line 10 with the above-described structure according to this embodiment will be described. For a planographic printing plate with an overcoat layer, a sensitivity of a photosensitive layer or a heat-sensitive layer to a laser beam exposure varies depending on the moisture content of the overcoat layer. Thus, an appropriate value for the moisture content of the overcoat layer varies depending on the type of such layers, i.e., the photosensitive layer and the heat-sensitive layer, the composition of the overcoat layer and the thickness of the same. Accordingly, in the producing line 10, the overcoat layer formed on the aluminum web 12 is temporarily put into an absolute dry state by the drying device 32. Then, the preliminary moisture adjusting device 34 adjusts the moisture content of the overcoat layer to a set target moisture content, depending on a type of the planographic printing plate.

Specifically, a controller (not shown) for the first moisture adjusting device 34 determines the type of a planographic printing plate to be produced, based on information from a process computer (not shown) for managing the entire producing line 10, reads out the target moisture content set in advance in a data table in accordance with this type of planographic printing plate and determines, for every predetermined control period, the moisture content of an overcoat layer measured by the first moisture content sensor 54 (measured moisture content). The first moisture adjusting device 34 sets a target temperature and a target humidity depending on the target moisture content and the measured moisture content for the overcoat layer, and air-conditions by an air conditioning unit so that an atmosphere within a moisture conditioning tank has the target temperature and the target humidity. Thus, when the aluminum web 12 passes through the humidity conditioning tank of the first moisture adjusting device 34, control (feedback control) is performed so that the moisture content of the overcoat layer formed on the aluminum web 12 approximates or coincides with the target moisture content.

Next, the moisture content of the overcoat layer on the aluminum web 12 which has passed through the humidity conditioning tank of the first moisture adjusting device 34 is measured by the secondary moisture content sensor 56. At this time, the secondary moisture content sensor 56 outputs a measured signal SW corresponding to the moisture content of the overcoat layer to the controller 40 of the secondary moisture adjusting device 60.

On the other hand, the controller 40 of the secondary moisture adjusting device 60 determines the type of planographic printing plate to be produced, based on information from a process computer (not shown) for managing the entire producing line 10, reads out a target moisture content set in advance in a data table in accordance with this type of planographic printing plate, determines the moisture content of the overcoat layer (measured moisture content) from the measured signal SW for every predetermined control period, and calculates a difference (deviation) between the measured moisture content and the target moisture content. The controller 40 calculates a target temperature OT and a target humidity OH based on the deviation calculated for every predetermined control period and sets these target temperature OT and target humidity OH for the air conditioning control section 48. The air conditioning unit 42 thereby adjusts the temperature of air taken from outside and the humidity thereof to the target temperature OT and the target humidity OH, respectively and then supplies the adjusted air to the duct 46. Further, the air with its temperature and humidity having been adjusted is blown within the humidity conditioning tank 36 as conditioned air.

The moisture content of the interposing paper web 82 which has been conveyed within the humidity conditioning tank 36 is adjusted mainly depending on the humidity within the humidity conditioning tank 36 and the time from when the interposing paper web 82 enters the humidity conditioning tank 36 to the time when the interposing paper web 82 exits the same (passing time T) Specifically, if conditioned air with sufficiently low humidity is supplied within the humidity conditioning tank 36, the moisture content of the interposing paper web 82 is gradually decreased by the interposing paper web 82 entering the humidity conditioning tank 36 and then remains unchanged at a moisture content which is in equilibrium with respect to the humidity within the humidity conditioning tank 36. If conditioned air with sufficiently high humidity is supplied to the humidity conditioning tank 36, the moisture content of the interposing paper web 82 is gradually increased by the interposing paper web 82 entering the humidity conditioning tank 36 and then remains unchanged at a moisture content which is in equilibrium with respect to the humidity within the humidity conditioning tank 36. If the humidity of conditioned air supplied to the humidity conditioning tank 36 has already reached a state equilibrium with respect to the moisture content of the interposing paper web 82 prior to being conveyed to the humidity conditioning tank 36, the moisture content of the interposing paper web 82 hardly changes when the interposing paper 82 enters the humidity conditioning tank 36.

In accordance with the present embodiment, major change in the target temperature OT may cause fluctuation in a speed that the overcoat layer absorbs moisture. Thus, the secondary moisture adjusting device 60 of the present embodiment controls the air conditioning section 44 so that the target temperature OT is maintained generally constant even if the target humidity OH changes.

The humidity of the interposing paper web 82 reaches a state of equilibrium with respect to the humidity within the humidity conditioning tank 36 in a relatively shorter time, as compared to the case of the overcoat layer, and the moisture content of the interposing paper web 82 is adjusted to a moisture content corresponding to this humidity with high precision. Accordingly, if a pass length L of the interposing paper web 82 within the humidity conditioning tank 36 is set to be sufficiently longer relative to the time when the moisture content of the interposing paper web 82 attains equilibrium, the moisture content of the interposing paper web 82 which has exited from the humidity conditioning tank 36 can be controlled to a target value with high precision even when the line speed for the aluminum web 12 changes in accordance with a type or the like of planographic printing plate to be produced. Thus, the secondary moisture adjusting device 60 of the present embodiment is not provided with a moisture content sensor for measuring the moisture content of the interposing paper web 82 which has been output from the humidity conditioning tank 36. Nevertheless, the secondary moisture content sensor 56 may measure the moisture content of the interposing paper web 82 which has output from the humidity conditioning tank 36, and then feedback control may be performed for the humidity or the like within the humidity conditioning tank 36 depending on the measured moisture content.

In the secondary moisture adjusting device 60, the controller 40 firstly determines, for every predetermined control period, a measured moisture content of the overcoat layer based on a measured signal from the secondary moisture content sensor 56. If the measured moisture content of the overcoat layer formed on the aluminum web 12 is approximately the same as a target moisture content, the controller 40 sets a value (an adjusted moisture content), which is approximately the same as the target moisture content, as the moisture content of the interposing paper web 82 and controls the humidity and the temperature within the humidity conditioning tank 36 so that the interposing paper web 82 attains the adjusted moisture content within the humidity conditioning tank 36. As a result, moisture hardly moves between the overcoat layer of the aluminum web 12 having the interposing paper web 82 being adhered thereto and the interposing web paper 82. Consequently, the moisture content of the overcoat layer of the aluminum web 12 can be stably maintained at the target moisture content even after the interposing paper web 82 is adhered to the overcoat layer.

If the measured moisture content of the overcoat layer formed on the aluminum web 12 is lower than the target moisture content, the controller 40 sets an adjusted moisture content which is higher than the measured moisture content depending on the difference (deviation) between the measured moisture content and the target moisture content, and controls the humidity and the temperature within the humidity conditioning tank 36 so that the interposing paper web 82 attains the adjusted moisture content within the humidity conditioning tank 36. Moisture flows over time from the interposing paper web 82 into the overcoat layer of the aluminum web 12 having the interposing paper web 82 being adhered thereto. Thus, the moisture content of the overcoat layer of the aluminum web 12 may be increased so as to approximate the target moisture content with high precision after the interposing web paper 82 is adhered to the overcoat layer. As the deviation between the measured moisture content and the target moisture content is increased, values further higher than the target moisture content are set as the adjusted moisture content for the interposing paper web 82.

If the measured moisture content of the overcoat layer formed on the aluminum web 12 is higher than the target moisture content, the controller 40 sets an adjusted moisture content which is lower than the measured moisture content depending on the difference (deviation) between the measured moisture content and the target moisture content, and controls the humidity and the temperature within the humidity conditioning tank 36 so that the interposing paper web 82 attains the adjusted moisture content within the humidity conditioning tank 36. Moisture flows over time from the overcoat layer of the aluminum web 12 having the interposing paper web 82 being adhered thereto, to the interposing paper web 82. Thus, the moisture content of the overcoat layer of the aluminum web 12 may be decreased so as to approximate the target moisture content with high precision after the interposing paper web 82 is adhered to the overcoat layer. As the deviation between the measured moisture content and the target moisture content is increased, values lower than the target moisture content are set as the adjusted moisture content for the interposing paper web 82.

The controller 40 adjusts the moisture content of the interposing paper web 82 based on the measured moisture content SW, thereby performing control (feed forward control) for finally adjusting the moisture content of the overcoat layer of the aluminum web 12 to the target moisture content after the interposing paper web 82 is adhered to the overcoat layer. For the feed forward control, for example, in addition to a PID control, a fuzzy control, a fixed program control and the like may be utilized.

Accordance to the above-described producing line 10 of the first embodiment, the overcoat layer is formed on the aluminum web 12 and the moisture content of the overcoat layer is adjusted so as to approximate or coincide with the target moisture content by the first moisture adjusting device 34. Then, the interposing paper web 82 in which moisture content has been adjusted depending on a measured moisture content measured by the secondary moisture content sensor 56 is adhered on the surface of the overcoat layer. Thus, the moisture content contained in the overcoat layer formed on the aluminum web 12 can be maintained with high precision at a target moisture content set in advance in accordance with a type or the like of planographic printing plate or can be adjusted thereto over time. As a result, an unstable quality of planographic printing plate caused by the moisture content of the overcoat layer can be effectively suppressed.

According to the above-described secondary moisture adjusting device 60 of this embodiment, the controller 40 feedback-controls the air conditioning unit 42 based on a measured moisture content SW measured by the secondary moisture content sensor 56 and a target moisture content so that the moisture content of the overcoat layer on the aluminum web 12 reaches the target moisture content within the humidity conditioning tank 36. Thus, the moisture content of the overcoat layer formed on the aluminum web 12 passing through the humidity conditioning tank 36 can be stably adjusted to a target moisture content in accordance with a type of planographic printing plate. As a result, a quality of planographic printing plate can be effectively prevented from being unstable due to the influence of the moisture content of the overcoat layer formed on the surface of a photosensitive layer or a heat-sensitive layer in the planographic printing plate.

(Second Embodiment)

Figure 3:
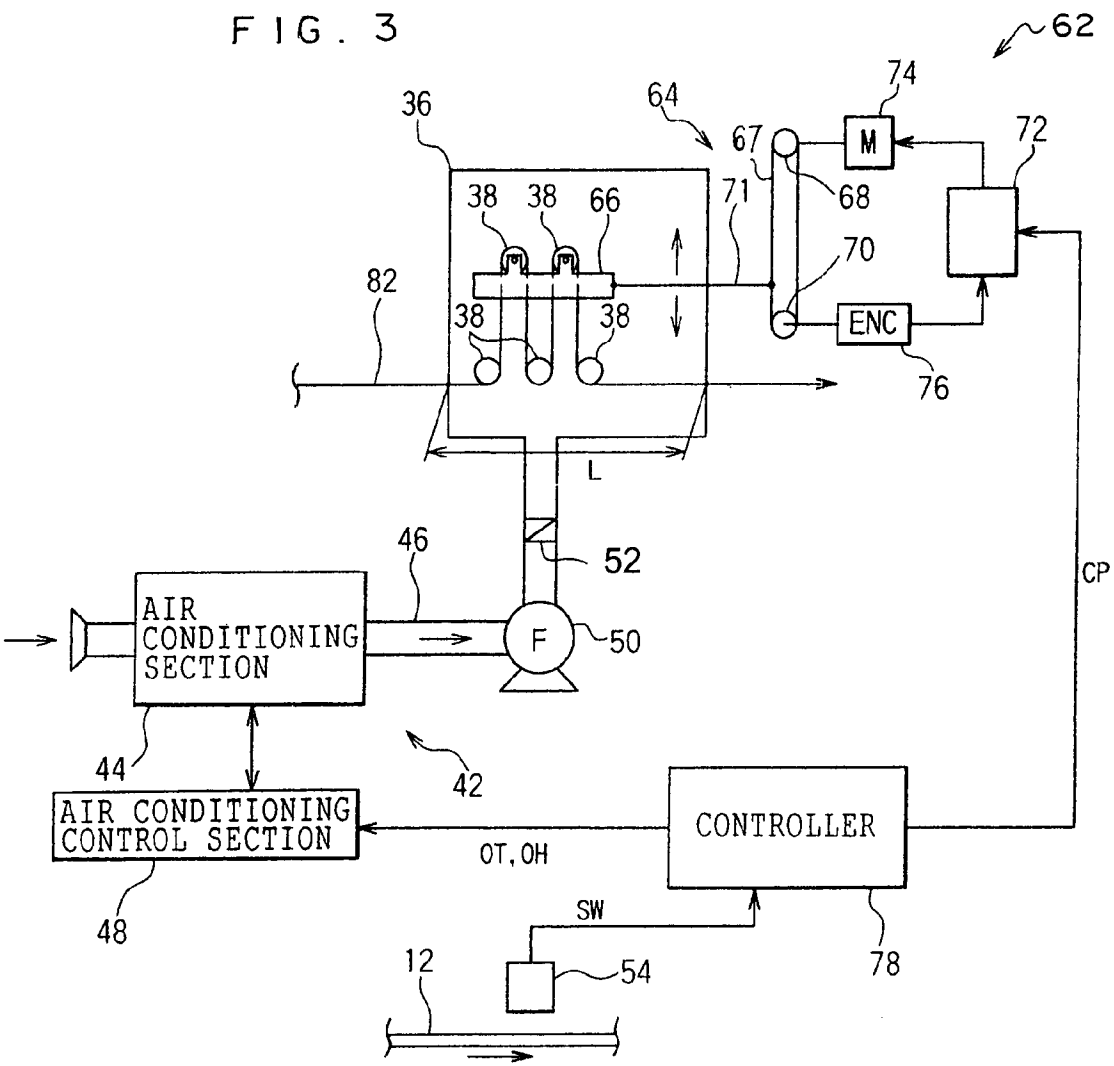
FIG. 3 is a block diagram illustrating a structure of a secondary moisture adjusting device according to a second embodiment of the invention.

FIG. 3 shows a moisture adjusting device 62 according to a second embodiment of the invention. The moisture adjusting device 62 is applied to the producing line 10, in place of the secondary moisture adjusting device 60 according to the first embodiment. Members for the moisture adjusting device 62 according to the second embodiment that have common structure and operation to those of the secondary moisture adjusting device 60 according to the first embodiment are denoted by the same reference numerals, and descriptions thereof will be omitted.

The secondary moisture adjusting device 62 shown in FIG. 3 is different from the secondary moisture adjusting device 60 shown in FIG. 2 in that a pass length adjusting mechanism 64 for adjusting a pass length of the interposing paper web 82 within the humidity conditioning tank 36 is provided, and a function of controlling the pass length adjusting mechanism 64 is added to a controller 78. The pass length L adjusted by the pass length adjusting mechanism 64 refers to the length in which the interposing paper web 82 tautened by the pass rolls 38 exists in the humidity conditioning tank 36. A time required for the interposing paper web 82 to pass through the humidity conditioning tank 36, i.e., a passing time T is determined by the pass length L and a conveyance speed for the interposing paper web 82.

A carriage 66 for axially supporting two pass rolls 38 disposed at an upper side, among pass rolls 38 alternately disposed at an upper side and a lower side within the humidity conditioning tank 36, is provided in the pass length adjusting mechanism 64. The carriage 66 is supported so as to be movable in a vertical direction integrally with the two pass rolls 38 disposed at the upper side within the humidity conditioning tank 36. Thus, the pass length L of the interposing paper web 82 within the humidity conditioning tank 36 varies depending on positions of the carriage 66 along the vertical direction. The pass length adjusting mechanism 64 has a loop belt member 67 which is tautened by a pair of sprockets 68, 70. One sprocket 68 is supported above an upper limit position in a movable range for the carriage 66, and the other sprocket 70 is supported below a lower limit position in the movable range for the carriage 66. The carriage 66 is coupled via a coupling arm 71 to the belt member 67.

The pass length adjusting mechanism 64 is provided with a pass length control section 72 as a control section for the entire mechanism 64. Further, a driving motor 74 coupled to the sprocket 68 and an encoder 76 coupled to the sprocket 70 are also provided in the pass length adjusting mechanism 64, respectively. The driving motor 74 is formed of a servo-controllable motor and receives a driving signal from the pass length control section 72 to rotate by a required amount in a direction corresponding to the driving signal. The encoder 76 outputs measured pulses, which are in proportion to an amount of rotation for the sprocket 70, to the pass length control section 72.

When the pass length L is to be changed, a controller 78 calculates a direction and a distance that the carriage 66 is controlled, based on a difference between the present pass length L and a changed pass length L, and outputs a positional control signal CP corresponding to a control direction and a control distance to the pass length control section 72. When receiving the positional control signal CP, the pass length control section 72 rotates the driving motor 74 in a rotational direction corresponding to the control direction, measures the distance the carriage 66 is moved based on a number of measured pulses inputted from the encoder 76 and stops the driving motor 74 at a timing that the measured distance coincides with the control distance. As a result, the pass length L of the interposing paper web 82 within the humidity conditioning tank 36 is adjusted to a required length.

Although the pass length adjusting mechanism 64 according to this embodiment uses the belt member 67 driven by the driving motor 74 in order to move the carriage 66, any mechanism may be used as long as it can drive the carriage 66 in a vertical direction. For example, a linear actuator operated by an oil pressure, a gas pressure, a stepping motor or the like may be coupled to the carriage 66 so that the carriage 66 is moved vertically by the linear actuator. The pass length L may be adjusted by forming the humidity conditioning tank 36 so as to be capable of expanding along a conveyance direction for the interposing paper web 82, instead of moving the pass rolls 38 vertically.

Like the controller 40 according to the first embodiment, the controller 78 basically controls the air conditioning unit 42 based on a measured moisture content detected by the secondary moisture content sensor 56, to adjust a moisture content for the interposing paper web 82 to be adhered to the overcoat layer of the aluminum web 12 to an adjusted moisture content corresponding to the measured moisture content (of the overcoat layer).

Further, the controller 78 performs control for adjusting the pass length L by the pass length adjusting mechanism 64 so that the interposing paper web 82 coincides with the adjusted moisture content within the humidity conditioning tank 36 with high precision. Specifically, for example, the controller 78 adjusts the pass length L by the pass length adjusting mechanism 64 so that the passing time T is maintained constant even if the conveyance speed for the interposing paper web 82 varies greatly. Thus, variation in the passing time T which may cause variation in the moisture content is eliminated. As a result, as compared to the case of the first embodiment, the moisture content of the interposing paper web 82 can be adjusted to an adjusted moisture content with higher precision. In addition to control in accordance with variation in the conveyance speed, the pass length L may be adjusted depending on variation in size such as the thickness of the interposing paper web 82 and variation in the type of materials that may be additional factors for variation in the moisture content.

Accordance to the producing line 10 of this embodiment, the interposing paper web 82 made of a paper such as a kraft paper is used as a protective sheet material formed on the aluminum web 12. Nevertheless, a vinyl or the like formed in a sheet may be used as the protective sheet material for the overcoat layer as long as it has a water absorbing property and is capable of transferring moisture held therein to the overcoat layer. In the producing line 10, the interposing paper web 82 is adhered to the overcoat layer immediately after the moisture content of the overcoat layer formed on the aluminum web 12 is adjusted by the first moisture adjusting device 34. Alternatively, the aluminum web 12 with the moisture content of the overcoat layer thereof having been adjusted is temporarily taken up in a roll as a web roll. Then, the interposing paper web 82 with the moisture content thereof having been adjusted by the secondary moisture adjusting devices 60, 62 may be adhered to the overcoat layer of the aluminum web 12 unwound from the web roll.

As described above, according to the moisture adjusting device of the present invention, the moisture content contained in a coating film layer formed on a support web can be maintained with high precision at a target moisture content even after a protective sheet material is adhered to the coating film layer.

According to the planographic printing plate producing method of the present invention, the moisture content contained in an overcoat layer formed on the surface of a photosensitive layer or a heat-sensitive layer can be maintained with high precision at a target moisture content set in advance in accordance with a type of planographic printing plate even after the protective sheet material is adhered to the overcoat layer.

What is claimed is:

1. A planographic printing plate producing method, comprising the steps of:

forming a coating film layer on a surface of at least one of a photosensitive layer or a heat-sensitive layer after forming the at least one of the photosensitive layer or the heat-sensitive layer on a support;

providing a protective sheet material and adjusting a moisture content of the protective sheet material by a moisture adjusting device, said moisture adjusting device comprising:

a coating film layer moisture adjusting device for adjusting to a target moisture content a moisture content of the coating film layer formed by applying a coating solution to the support, which support is continuously conveyed;

a humidity conditioning zone for having the protective sheet material, which is formed in an elongated sheet-shape and is to be adhered to a surface of the coating film layer formed on the support, pass therethrough;

humidity conditioning means for adjusting humidity in the humidity conditioning zone;

moisture content measuring means for measuring a moisture content of the coating film layer; and humidity conditioning control means for controlling the humidity conditioning means so that the humidity in the humidity conditioning zone becomes a target humidity corresponding to the measured moisture content of the coating film layer measured by the moisture content measuring means and the target moisture content, and adjusting the moisture content of the protective sheet material, which has passed through the humidity conditioning zone, to an adjusted moisture content corresponding to the measured moisture content and the target moisture content; and providing an adhering means disposed at a downstream side of the humidity conditioning zone and continuously adhering the protective sheet material to the surface of the coating film layer.

2. A planographic printing plate producing method, comprising the steps of:

(a) forming a coating film layer on a support;

(b) setting a target moisture content as a weight ratio of moisture, which should be contained in the coating film layer;

(c) measuring a moisture content of the coating film layer;

(d) making a protective sheet material, which is formed in an elongated sheet-shape and is to be adhered to the surface of the coating film layer formed on the support, pass through a humidity conditioning zone;

(e) adjusting a humidity within the humidity conditioning zone to a target humidity corresponding to the measured moisture content of the coating film layer measured in the moisture content measuring step (c) and the target moisture content, so as to adjust the moisture content of the protective sheet material, which has passed through the humidity conditioning zone, to an adjusted moisture content corresponding to the measured moisture and the target moisture content; and (f) adhering continuously the protective sheet material, the moisture content of which was adjusted to the adjusted moisture content in the adjusting step (e), to the surface of the coating film layer.

3. A planographic printing plate producing method according to claim 2, wherein the adjusting step (e) comprises the step of:

(e-1) when the measured moisture content of the coating film layer is approximately the same as the target moisture content, setting the adjusted moisture content of the protective sheet material to a value, which is approximately the same as the target moisture content, and controlling the humidity and a temperature within the humidity conditioning zone so that the protective sheet material attains the adjusted moisture content in the humidity conditioning zone.

4. A planographic printing plate producing method according to claim 2, wherein the adjusting step (e) comprises the step of:

(e-2) when the measured moisture content of the coating film layer is lower than the target moisture content, setting the adjusted moisture content of the protective sheet material to be higher than the measured moisture content in accordance with a deviation between the measured moisture content and the target moisture content, and controlling the humidity and temperature within the humidity conditioning zone so that the protective sheet material attains the adjusted moisture content in the humidity conditioning zone.

5. A planographic printing plate producing method according to claim 2, wherein the adjusting step (e) comprises the step of:

(e-3) when the measured moisture content of the coating film layer is higher than the target moisture content, setting the adjusted moisture content of the protective sheet material to be lower than the measured moisture content in accordance with a deviation between the measured moisture content and the target moisture content, and controlling the humidity and the temperature within the humidity conditioning zone so that the protective sheet material attains the adjusted moisture content in the humidity conditioning zone.

6. A planographic printing plate producing method according to claim 2, further comprising, between the setting step (b) and the measuring step (c), a preliminary adjusting step (g) for making the moisture content of the coating film layer approximate the target moisture content.

7. A planographic printing plate producing method according to claim 6, wherein the preliminary adjusting step (g) comprises the step of measuring the moisture content of the coating film layer and performing feedback control in accordance with the measured moisture content, so as to make the moisture content of the coating film layer approximate the target moisture content.

8. A planographic printing plate producing method according to claim 2, wherein the adjusting step (e) further comprises the step of measuring, before the adhering step (f), the moisture content of the protective sheet material which has been output from the humidity conditioning zone and performing feedback control in accordance with the measured moisture content, so as to make the moisture content of the protective sheet material, which has passed through the humidity conditioning zone, further approximate the adjusted moisture content.

9. A planographic printing plate producing method according to claim 2, further comprising a pass length adjusting step (h) for one of increasing or decreasing the pass length of the protective sheet material in the humidity conditioning zone in accordance with at least one of a conveyance speed of the protective sheet material or the adjusted moisture content.

10. A planographic printing plate producing method according to claim 9, wherein the pass length adjusting step (h) comprises the step of adjusting the pass length so that the moisture content of the protective sheet, which has passed through the humidity conditioning zone, further approximates the adjusted moisture content.

11. A planographic printing plate producing method according to claim 9, wherein the pass length adjusting step (h) comprises the step of adjusting the pass length so that a passing time required for the protective sheet material to pass through the humidity conditioning zone is substantially constant regardless of the conveyance speed for the protective sheet material.

* * * * *